US007159362B2

(12) United States Patent
Chen

(10) Patent No.: US 7,159,362 B2
(45) Date of Patent: Jan. 9, 2007

(54) SHUTTER MOUNTING ADJUSTER

(76) Inventor: Lawrence Chen, Room B, 25Fl., No. 51, Sec. 2, Gungyi Rd., Nantuen Chiu, Taichung 408 (TW)

( * ) Notice: Subject to any disclaimer, the term of this patent is extended or adjusted under 35 U.S.C. 154(b) by 413 days.

(21) Appl. No.: 10/414,248

(22) Filed: Apr. 16, 2003

(65) Prior Publication Data

US 2004/0206005 A1 Oct. 21, 2004

(51) Int. Cl.
*E06B 1/04* (2006.01)

(52) U.S. Cl. ..... 49/505; 52/126.1

(58) Field of Classification Search ..... 49/74.1, 49/505; 52/126.1, 126.3, 126.5, 211
See application file for complete search history.

(56) References Cited

U.S. PATENT DOCUMENTS 373,067 A * 11/1887 Hartman ..... 49/74.1
1,821,744 A * 9/1931 Drummond ..... 49/96
2,914,817 A * 12/1959 Jackson ..... 49/380
3,180,246 A * 4/1965 Johnson ..... 454/319
3,571,996 A * 3/1971 Braswell ..... 52/217
3,654,734 A * 4/1972 Lehman ..... 49/505
4,731,965 A * 3/1988 Jensen ..... 52/126.1
5,655,342 A * 8/1997 Guillemet et al. ..... 52/217
5,692,350 A * 12/1997 Murphy, Jr. ..... 52/213
6,076,305 A * 6/2000 Hsu ..... 49/505
6,178,717 B1 * 1/2001 Loop ..... 52/714
6,474,034 B1 * 11/2002 Dronigi ..... 52/473
2001/0020350 A1 * 9/2001 Gorman ..... 52/210

* cited by examiner

*Primary Examiner*—Gregory J. Strimbu
(74) *Attorney, Agent, or Firm*—Browdy and Neimark, PLLC

(57) ABSTRACT

A shutter mounting adjuster provided between a non-vertical peripheral wall of a shutter opening and a hanging strip hinged to a shutter to support the shutter in the shutter opening. A slider movably mounted in a longitudinal groove of the hanging strip of the shutter, and an arched spring strip fixed on the slider for movement with the slider along the longitudinal groove for enaging the non-vertical peripheral wall to postion the hanging strip vertically in the shutter opening.

6 Claims, 3 Drawing Sheets

SHUTTER MOUNTING ADJUSTER

BACKGROUND OF THE INVENTION

1. Field of the Invention

The present invention relates to shutter mounting techniques and, more specifically, to a shutter mounting adjuster, which enables the shutter to be quickly installed in a window of a building and easily adjusted to the accurate position during installation.

2. Description of the Related Art

When constructing a building, openings are left in the outer wall of the building for mounting shutters. However, the openings may not perfectly fit the size of the shutters to be installed. When a shutter set in vertical in one opening in the outer wall of a building, a gap may be left between the hanging strip of the shutter and a non-vertical peripheral wall of the opening. In this case, the gap must be sealed with filler means. FIG. 1 shows the installation of a shutter according to a conventional method. As illustrated, a gap 5 is left between non-vertical peripheral wall 3 of the opening of the building and the hanging strip 2 of the shutter 1 after the shutter 1 has been set in vertical in the opening of the building, and foamed filler materials 4 are stuffed in between the vertical peripheral wall 3 and the hanging strip 2 of the shutter 1 to seal the gap 5. This shutter mounting method has numerous drawbacks as outlined hereinafter.

1. It is complicated to seal the gap 5 with foamed filler materials 4. The worker may have to adjust the stuffing of the foamed filler materials 4 several times before the hanging strip 2 of the shutter 1 accurately adjusted to vertical position.

2. The foamed filler materials 4 will become aged soon after installation of the shutter 1. When the foamed filler materials 4 aged, they cannot support the shutter 1 firmly in position, and the shutter 1 tends to be biased after the foamed filler materials 4 aged.

3. The foamed filler materials 4 tend to project out of the gap 5, destroying the sense of beauty of the outer appearance of the building.

SUMMARY OF THE INVENTION

The present invention has been accomplished under the circumstances in view. It is the primary object of the present invention to provide a shutter mounting adjuster, which improves shutter mounting efficiency.

It is another object of the present invention to provide a shutter mounting adjuster, which prolongs the service life of the shutter.

It is still another object of the present invention to provide a shutter mounting adjuster, which decorates the shutter, causing a sense of beauty.

To achieve these objects of the present invention, the shutter mounting adjuster is provided between a non-vertical peripheral wall of a shutter opening and a hanging strip, which has a longitudinal sliding groove, of a shutter to support the shutter in vertical, comprising a slider mounted in the longitudinal sliding groove of the hanging strip of the shutter and movable along the longitudinal sliding grove, and a spring member fixedly mounted on the slider for movement with the slider along the longitudinal sliding groove of the hanging strip of the shutter. The spring member has a portion thereof pressed on the vertical peripheral wall.

DETAILED DESCRIPTION OF THE INVENTION

Figure 1:
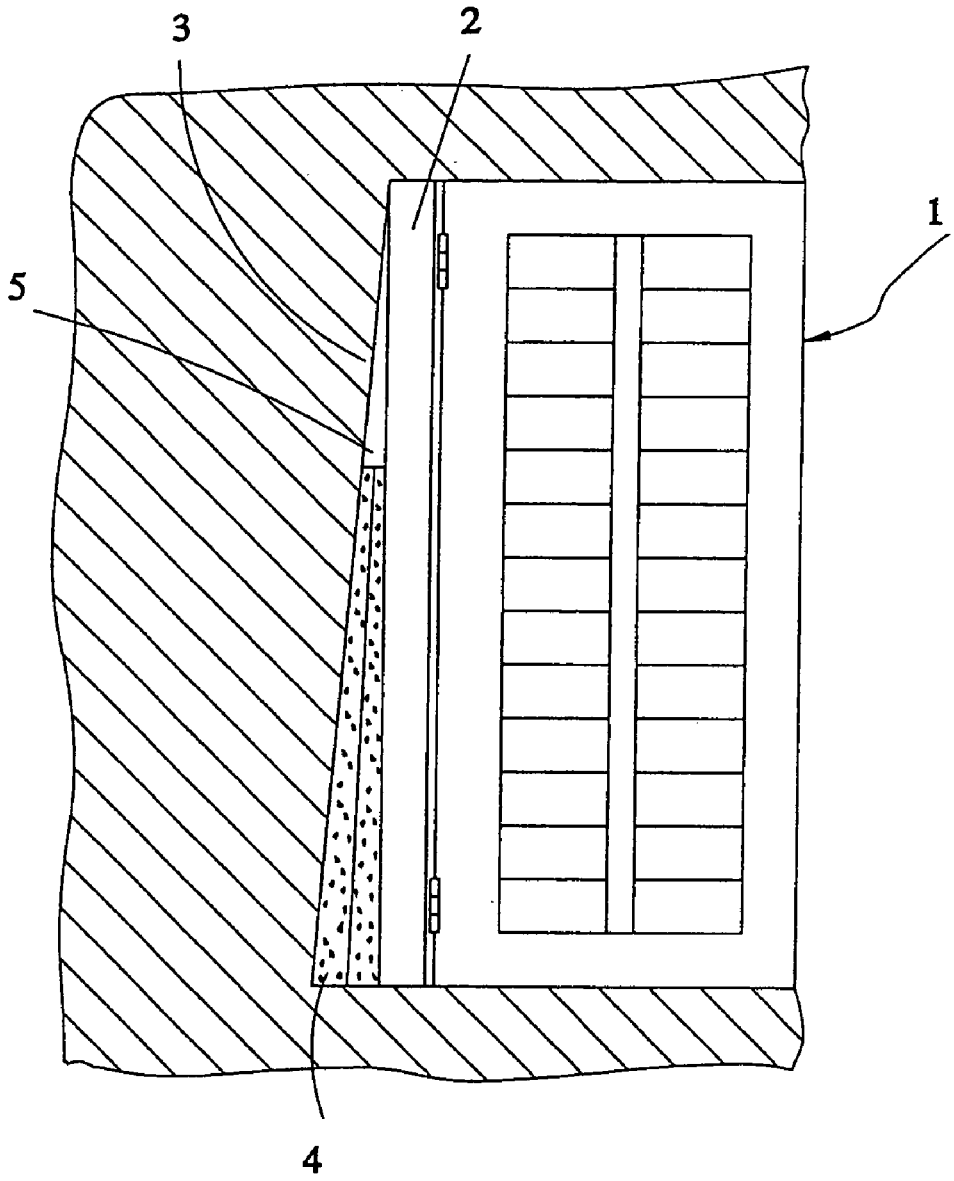
FIG.1 PRIOR ART
FIG. 1 is a schematic drawing showing a shutter installed in a wall opening according to the prior art.
Figure 2:
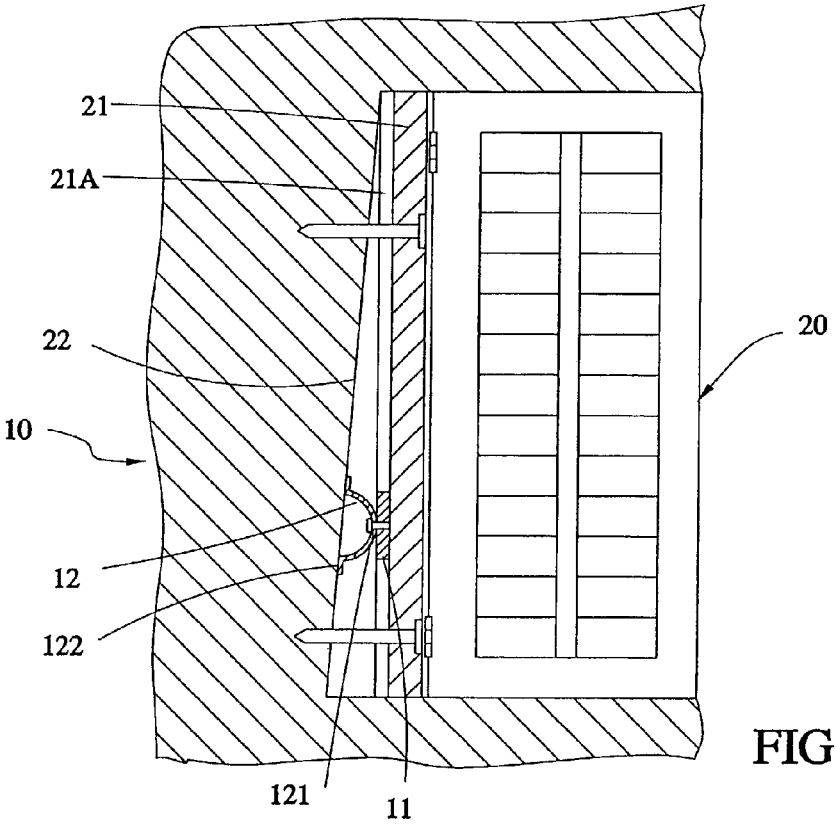
FIG. 2 is a schematic installed view of a first preferred embodiment of the present invention.

As shown in FIG. 2, a shutter mounting adjuster 10 is provided between a non-vertical peripheral wall 22 of a shutter opening and the hanging strip 21 of a shutter 20. The hanging strip 21 has a longitudinal sliding groove 21A longitudinally extended through the top and bottom ends of one side thereof and facing the wall 22. The shutter mounting adjuster 10 comprises a slider 11 movably mounted in the longitudinal sliding groove 21A of the hanging strip 21, and an arched spring strip 12 fixedly mounted on the slider 11. The arched spring strip 12 has an arched body portion 121 fixed to the slider 11, and two bearing tips 122 respectively extended from the two distal ends of the arched body portion 121 in reversed directions for pressing on the wall 22.

During installation of the shutter 20, the shutter 20 is vertically set in the shutter opening by keeping the two bearing tips 122 of the arched spring strip 12 pressed on the wall 22, and moving the slider 11 along the longitudinal sliding groove 21A to a suitable elevation where the arched spring strip 12 imparts a pressure to the shutter 20 to hold down the shutter 20 accurately in vertical. Thereafter nails, screws, or proper fastening members are driven through the hanging strip 21 of the shutter 20 into the wall 22 to fixedly secure the shutter 20 to the wall 22.

Figure 3:
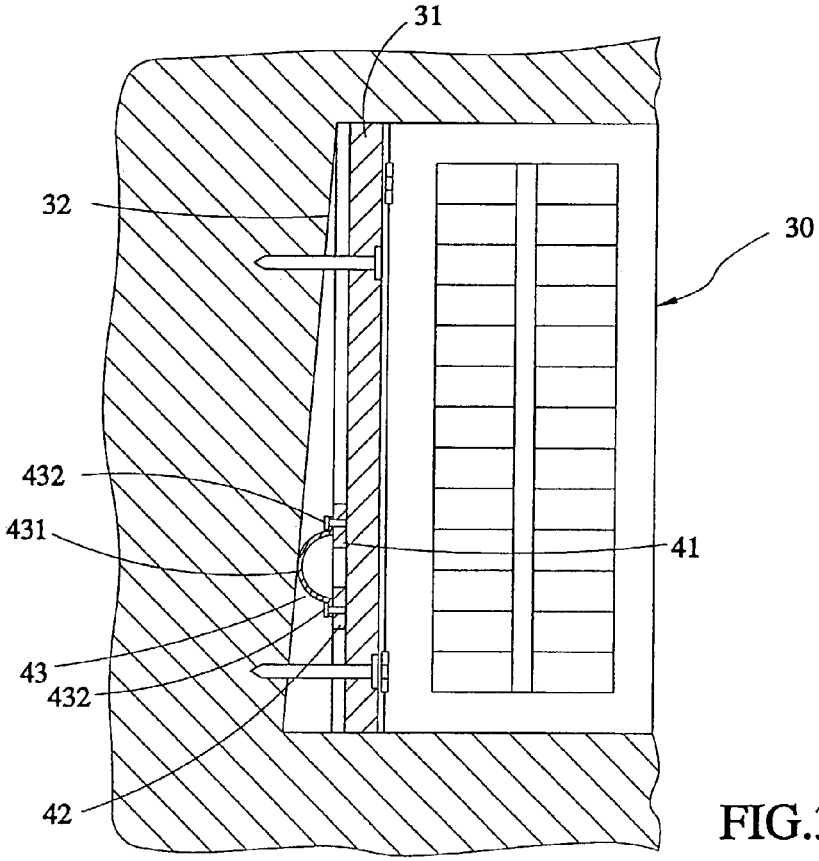
FIG. 3 is a schematic installed view of a second preferred embodiment of the present invention.

FIG. 3 shows an alternate form of the present invention. According to this embodiment, the shutter mounting adjuster is provided between one vertical peripheral wall 32 of the shutter opening and the hanging strip 31 of a shutter 30, and comprising two sliders 41 and 42 movably mounted in the longitudinal sliding groove of the hanging strip 31 of the shutter 30, and an arched spring strip 43 fixed on the sliders 41 and 42. The arched spring strip 43 has an arched body portion 431 pressed against the wall 32, and two mounting tips 432 respectively extended from the two distal ends of the arched body portion 431 in reversed directions and respectively fixed to the sliders 41 and 42.

Figure 4:
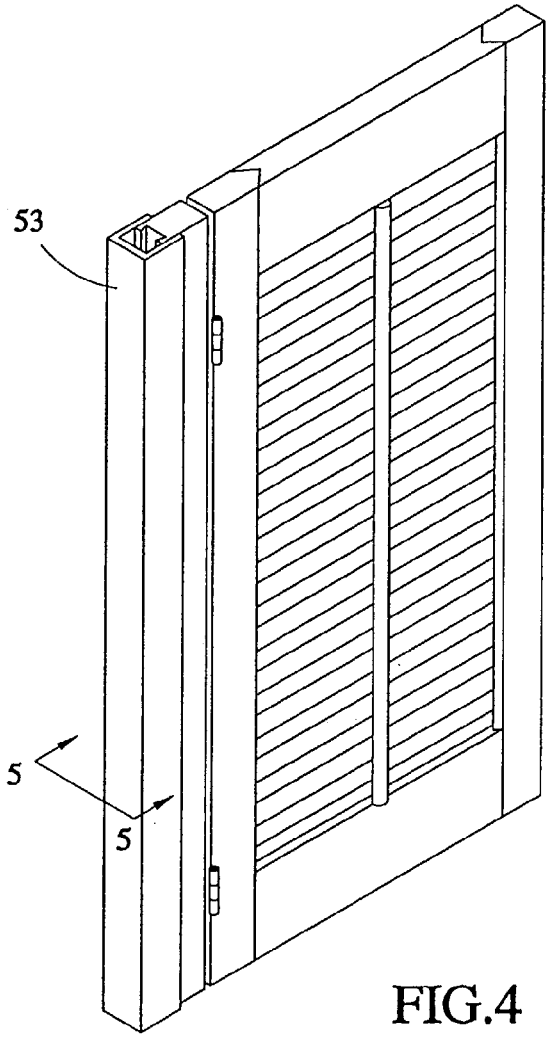
FIG. 4 is a perspective view of a third preferred embodiment of the present invention.
Figure 5:
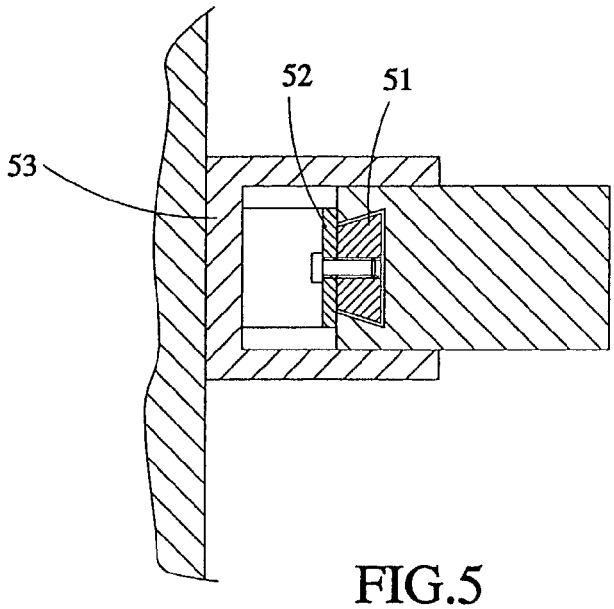
FIG. 5 is a sectional view taken along line 5—5 of FIG. 4.

FIGS. 4 and 5 show another alternate form of the present invention. According to this embodiment, the shutter mounting adjuster further comprises an ornamental cover strip 53 shaped like a channel bar having a U-shaped cross section and adapted to protect the slider 51 and the spring strip 52 against external bodies and to enhance the sense of beauty of the shutter.

A prototype of the shutter mounting adjuster has been constructed with the features of FIGS. 2~5. The shutter mounting adjuster functions smoothly to provide all of the features discussed earlier.

Although particular embodiments of the invention have been described in detail for purposes of illustration, various modifications and enhancements may be made without departing from the spirit and scope of the invention. For example, any of a variety of other shapes and forms of spring members may be used instead of the aforesaid arched spring strip. Accordingly, the invention is not to be limited except as by the appended claims.

What is claimed is:

1. A shutter mounting adjuster adapted for use between a non-vertical peripheral wall of a shutter opening and a shutter, comprising:

a hanging strip hinged to the shutter to support the shutter in the shutter opening, the hanging strip of said shutter having a longitudinal groove facing the non-vertical peripheral wall and extending over the entire length of the hanging strip;

at least one slider substantially shorter than the length of the hanging strip having a spring fixed thereon, wherein said spring and said slider comprise seperate elements interconnected via a fastner, wherein the slider with the spring fixed thereon are slidably engaged in the longitudinal groove when the shutter and hanging strip are installed in the shutter opening to permit the slider to move in the longitudinal groove until a portion of the spring is engaged to the non-vertical peripheral wall and positions the hanging strip vertically in the shutter opening.

2. The shutter mounting adjuster according to claim 1, wherein the slider comprises two sliders, and the spring comprises an arched shaped spring strip having opposite ends fixed to the sliders and an apex engaged to the non-vertical peripheral wall when the hanging strip is positioned vertically in the shutter opening.

3. The shutter mounting adjuster according to claim 2, further comprises an ornamental cover strip having a U-shaped cross section having sides which engage to opposite sides of the hanging strip.

4. The shutter mounting adjuster according to claim 1, wherein the slider is formed as an integral unit, and the spring comprises an arched shaped spring strip having an apex fixed to the slider and opposite ends engaged to the non-vertical peripheral wall when the hanging strip is positioned vertically in the shutter opening.

5. The shutter mounting adjuster according to claim 4, further comprises an ornamental cover strip having a U-shaped cross section having sides which engage to opposite sides of the hanging strip.

6. The shutter mounting adjuster according to claim 1, wherein said slider comprises two sliders slidably engaged in the longitudinal groove.

* * * * *